US009784112B2

(12) United States Patent
Briend et al.

(10) Patent No.: US 9,784,112 B2
(45) Date of Patent: Oct. 10, 2017

(54) TURBINE ENGINE VANE WITH ASYMMETRICAL PROFILE

(71) Applicants: SNECMA, Paris (FR); SAFRAN, Paris (FR)

(72) Inventors: Maxime Briend, Massy (FR); Sebastien Pautard, Palaiseau (FR)

(73) Assignees: SNECMA, Paris (FR); SAFRAN, Paris (FR)

( * ) Notice: Subject to any disclaimer, the term of this patent is extended or adjusted under 35 U.S.C. 154(b) by 379 days.

(21) Appl. No.: 14/511,624

(22) Filed: Oct. 10, 2014

(65) Prior Publication Data

US 2015/0104299 A1 Apr. 16, 2015

(30) Foreign Application Priority Data

Oct. 11, 2013 (FR) ..... 13 59878

(51) Int. Cl.

| | |
|---|---|
| ***F01D 25/00*** | (2006.01) |
| ***F01D 9/02*** | (2006.01) |
| ***F01D 5/14*** | (2006.01) |
| ***F01D 5/28*** | (2006.01) |

(52) U.S. Cl.

CPC ..... *F01D 9/02* (2013.01); *F01D 5/147* (2013.01); *F01D 5/282* (2013.01); *F01D 25/005* (2013.01); *F01D 5/288* (2013.01); *F05D 2220/36* (2013.01); *F05D 2240/121* (2013.01); *F05D 2240/303* (2013.01); *F05D 2300/603* (2013.01)

(58) Field of Classification Search

CPC ..... F01D 5/147; F01D 5/282; F01D 25/005; F01D 9/02

See application file for complete search history.

(56) References Cited

U.S. PATENT DOCUMENTS

| | | | | |
|---|---|---|---|---|
| 3,294,366 | A | 12/1966 | Coplin | |
| 3,758,234 | A * | 9/1973 | Goodwin | F01D 5/282 416/230 |
| 6,471,485 | B1 * | 10/2002 | Rossmann | F01D 5/147 416/223 A |
| 8,777,577 | B2 * | 7/2014 | Schreiber | B21D 53/78 416/224 |
| 8,827,654 | B2 * | 9/2014 | Schreiber | F01D 5/286 416/224 |

(Continued)

FOREIGN PATENT DOCUMENTS

WO WO 2012/038217 A1 3/2012

OTHER PUBLICATIONS

French Preliminary Search Report dated Feb. 5, 2014 in Patent Application No. 1359878 (with English Translation of Category of Cited Documents).

*Primary Examiner* — Woody Lee, Jr.
(74) *Attorney, Agent, or Firm* — Oblon, McClelland, Maier & Neustadt, L.L.P.

(57) ABSTRACT

The invention relates to a turbine engine vane comprising a main body made of composite material, a leading edge, a trailing edge, and at least one metal structural reinforcement, the structural reinforcement comprising a junction surface portion connected to the main body, the structural reinforcement extending between the junction surface portion and one of the leading or trailing edges, the vane being characterized in that the profile of the junction surface portion of the structural reinforcement has a camber less than 30%.

7 Claims, 3 Drawing Sheets

(56) References Cited

U.S. PATENT DOCUMENTS

| | | | | |
|---|---|---|---|---|
| 9,429,026 | B2 * | 8/2016 | Schreiber | F01D 5/147 |
| 9,482,102 | B2 * | 11/2016 | Klein | F04D 29/023 |
| 2004/0184921 | A1 * | 9/2004 | Schreiber | B23P 15/04 416/229 R |
| 2012/0207608 | A1 | 8/2012 | Ebert et al. | |

* cited by examiner

TURBINE ENGINE VANE WITH ASYMMETRICAL PROFILE

BACKGROUND OF THE INVENTION

The invention relates to the field of vanes for turbine engine.

Vanes from the prior art are known, comprising a main body and a metallic reinforcement on their leading edge or their trailing edge designed to protect the main body during impact by a foreign body such as a bird taken in by the turbine engine.

In reference to FIG. 1A, a vane A fitted with a metallic reinforcement R in the form of a foil covering the main body CP of the vane in the vicinity of the leading edge BA of the vane A has already been proposed in patent application FR 2 732 406 A1. The foil R has a profile (illustrated in FIGS. 1B and 1C) comprising a central part in the vicinity of the leading edge BA, and two opposite protrusions of material extending from the central part, on either side of the main body CP.

But such a foil has a number of drawbacks. A reinforcement of foil type is not very rigid; it is therefore likely to undergo pinching or wrinkling during its assembly with the main body CP of the vane A. The assembly is also made complex because of the fine thickness of the two above-mentioned protrusions of material.

Also, the foil can, in use, be subject to tearing at the level of the leading edge. The foil also has an embrittlement zone F whereof the profile has a radius which depends on the preferred thickness of the vane. As a consequence, the foil R is not indicated to be connected to a main vane body of fine thickness as its embrittlement zone F has a profile of minimal radius; such a vane, after assembly of the reinforcement R, has a high risk of cracking following impact by a foreign body on the reinforcement.

A metal structural reinforcement connected to a main vane body made of composite material has also been proposed in patent application EP 1 908 919 A1, the profile of the reinforcement having a central part, and two opposite protrusions of material extending from the central part and defining a cavity wherein an end of the main body is housed. Arranged between the cavity and the leading edge is an additional recess designed to absorb some of the energy resulting from impact by a foreign body on the leading edge of the vane.

However, such a structural reinforcement is not entirely satisfactory, as the cavity defined between the protrusions of material and the recess extending this cavity necessarily give this reinforcement a minimal radius profile, if the main vane body to which this reinforcement is intended to be connected has minimal thickness.

To obtain a reinforcement having a larger radius profile, one solution could be to increase the length of the central part of the reinforcement between the leading edge and the main body. However, more material would have to be used or, as the reinforcement is metallic, the mass of the vane will be greater.

PRESENTATION OF THE INVENTION

An aim of the invention is to propose a vane protected in use from impact by foreign bodies and having easy assembly.

Another aim of the invention is to limit the extra mass given to a vane to protect it from such impacts.

Yet another aim of the invention is to define a reinforcement adapted to a wide variety of vane profiles, especially vanes having a fine thickness profile and/or non-zero camber.

A turbine engine vane is therefore proposed, comprising a main body made of composite material, a leading edge, a trailing edge, and at least one metal structural reinforcement, the structural reinforcement comprising a junction surface portion connected to the main body, the structural reinforcement extending between the junction surface portion and one of the leading or trailing edges, the vane being characterized in that the profile of the junction surface portion of the structural reinforcement has a camber of less than 30%.

The reinforcement of such a vane has a compact profile particularly resistant to shocks when the vane is operating. In particular, such a profile is exempt form protrusions of materials likely to be broken following impact by a foreign body on this reinforcement. The risks of the reinforcement cracking into several pieces following impact by a foreign body are therefore reduced.

The proposed vane comprises a reinforcement of simplified geometry; removing one of the two protrusions eliminates the disadvantage of a slight radius without increasing the mass of the vane.

The invention is advantageously completed by the following characteristics, taken singly or in any of their technically possible combinations.

The main body can comprise a junction surface portion which is complementary to the junction surface portion of the structural reinforcement, so as to increase the adhesion surface between the reinforcement and the main body.

The main body can comprise an intrados and an extrados, and the structural reinforcement comprise an intrados continuously following the intrados of the main body and an extrados continuously following the extrados of the main body to obtain a reinforced vane having an aerodynamic profile.

In addition, the profile of the junction portion of the structural reinforcement can comprise at least one discontinuity or not, comprise at most one point of inflection or not, be an arc, a curve or a broken line.

The invention also relates to a turbine engine comprising at least one vane as per the preceding description.

DESCRIPTION OF FIGURES

Other characteristics, aims and advantages of the invention will emerge from the following description which is purely illustrative and non-limiting and which must be considered in conjunction with the appended drawings, wherein.

In all figures, similar elements bear identical reference numerals.

DETAILED DESCRIPTION OF THE INVENTION

Figure 1A:
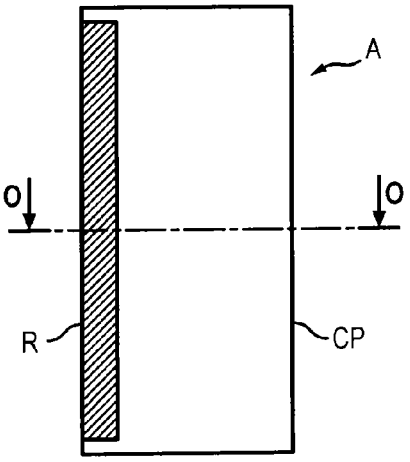
FIG. 1A shows a vane known from the prior art according to a plan view.
Figure 1B:
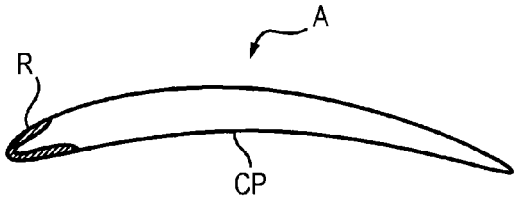
FIG. 1B is a view in transversal section of the vane of FIG. 1A according to the line O-O shown in FIG. 1.
Figure 1C:
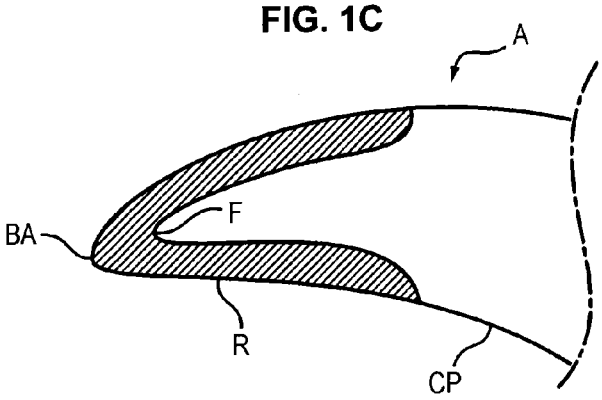
FIG. 1C is a partial view of the vane illustrated in FIG. 1B in the vicinity of its leading edge.
Figure 2:
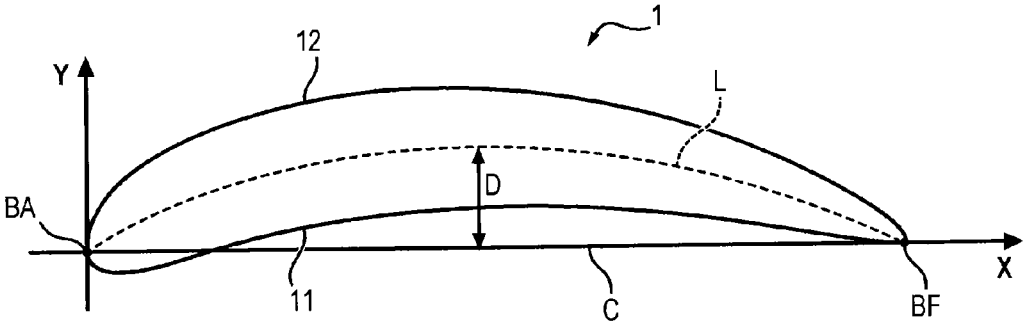
FIG. 2 is a view in transversal section of a vane according to an embodiment.

In reference to FIG. 2, a vane 1 extends in a longitudinal direction X between a leading edge BA and a trailing edge BF. The external surface of the vane comprises an intrados 11 and an extrados 12, the intrados 11 and the extrados 12 forming two opposite sides of the vane 1 each connecting the leading edge BA to the trailing edge BF.

A profile of the vane 1 is a section of this vane 1 in a sectional plane which traverses the intrados and the extrados of the vane 1, the sectional plane being parallel to the longitudinal direction X. Hereinbelow, the "profile" of any element of the vane 1 shall implicitly designate the intersection of this element with a sectional plane transversal to the predefined vane 1. But, what follows could be generalised to any sectional plane transversal to the vane parallel to this predefined plan.

By way of convention, when used alone the term "line" shall designate in this document a succession of points of free trajectory.

The profile of the vane 1 is conventionally defined by a bead C and a camber line L. The bead C is a straight line connecting the leading edge BA and the trailing edge BF. The camber line L is also the line formed by all the points equidistant from the intrados and the extrados according to a direction Y perpendicular to the bead C. The camber of the vane is equal to the ratio D/C, where D is the distance maximal in a direction orthogonal to the bead C between a point of the camber line L and the bead C. When the camber of the vane is zero, the camber line and the bead are therefore joined.

Figure 3:
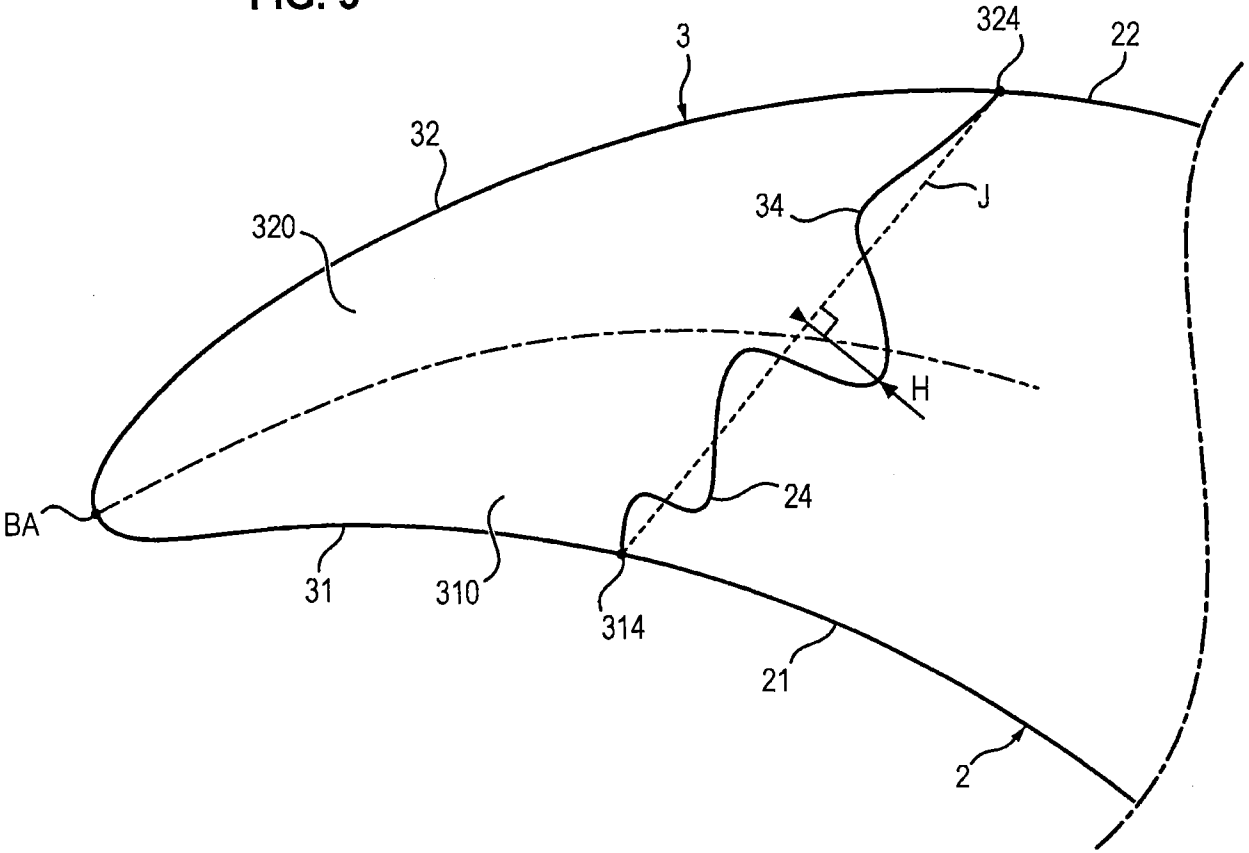
FIG. 3 is a partial view of the vane illustrated in FIG. 2 in the vicinity of its leading edge.

In reference to FIG. 3, the vane 1 comprises a main body 2 and a structural reinforcement 3 extending the main body 2 as far as the leading edge BA.

The main body 2 comprises a junction surface portion 24, an intrados 21 and an extrados 22.

Similarly, the reinforcement 3 comprises a surface portion 34, an intrados 31 and an extrados 32. The surface portion 34 is designed to be connected to the surface portion 24 during assembly of the vane 1. The intrados 31 and the extrados 32 each extend the junction surface portion 34 as far as the leading edge BA.

More precisely, the intrados 31 continuously follows the intrados 21 as far as the leading edge BA to define the intrados 11 of the vane, and the extrados 32 continuously follows the extrados 22 as far as the leading edge BA to define the extrados 12 of the vane. These two continuous extensions allow the vane 1 reinforced in this way in its leading edge to have an aerodynamic profile.

The junction surface of the reinforcement 34 is connected to the intrados 31 by a line 314, and connected to the extrados 32 by a line 324. The profile of each of these lines 314 and 324 is a point evident in FIG. 3.

The profile of the junction surface 34 of the reinforcement 3 is designated hereinbelow by the term "junction line" of the reinforcement 3.

In non-conventional terms, in the present document the "camber" of the profile of the junction surface 34 of the structural reinforcement 3 is defined as a H/J ratio, where:

H is the maximal distance between a point of the junction line 34 of the reinforcement 3 and the straight defined by points 314 and 324, the distance H being orthogonal to the line connecting the points 314 and 324, and J is the distance between the points 314 and 324.

The junction surface 34 has a profile whereof the camber is less than 30%. The inventors have discovered that this type of profile increases resistance of the reinforcement 3 to shocks during impact by a foreign body to this reinforcement 3, and especially prevents the reinforcement 3 from breaking into several parts.

Also, the junction surface portion 34 of the reinforcement 3 can be complementary to the surface portion 24 of the main body so a to offer a larger fixing or interpenetration surface between the reinforcement 3 and the main body 2, and therefore more solid. In this case, the surface portion 34 and the surface portion 24 have identical and complementary profiles.

Multiple profile embodiments for the junction surface 34 are feasible.

Figure 4A:
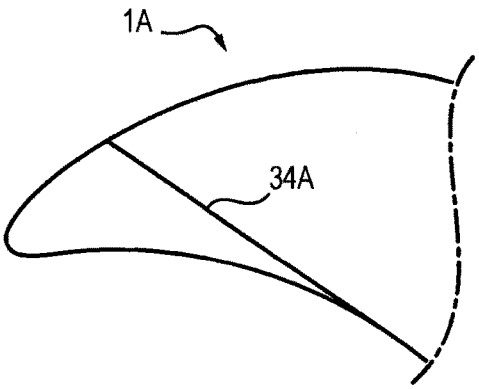
FIGS. 4A to 4D are partial views of vanes according to four other embodiments.

In a vane embodiment 1A shown in FIG. 4A, the profile of the junction surface 34E is rectilinear. In this embodiment, manufacture of the reinforcement and of the main body is greatly simplified.

Figure 4B:
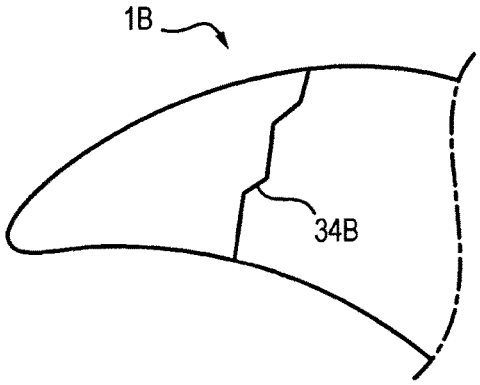

In another vane embodiment 1B shown in FIG. 4B, the profile of the junction surface 34B has at least one cracking, so as to limit any play of the reinforcement 3 in the axis defined by the points 314 and 324, and therefore improve the stability of the reinforcement connected to the main body. Such cracking can for example be an apex introducing a change of trajectory of angle of between 45° and 90°. In a particular variant, the profile of the junction surface 34 of the reinforcement 3 is a broken line comprising a succession of straight segments offering a good comprise between simplicity of manufacture and stability.

Figure 4C:
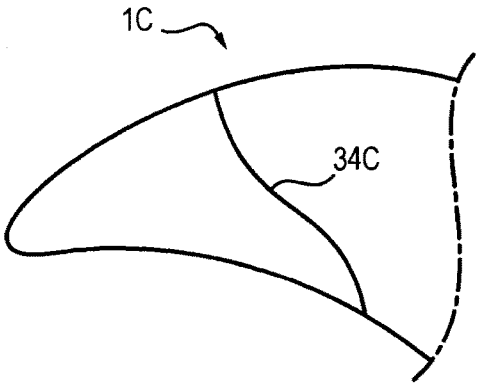
Figure 4D:
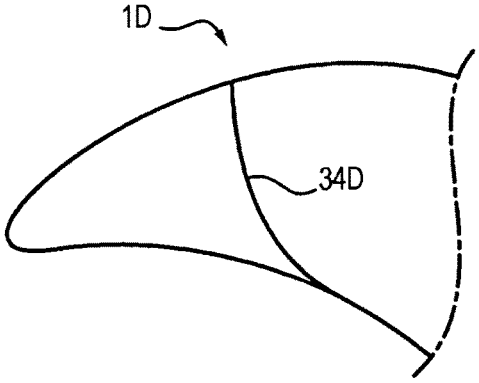

In the embodiment illustrated in FIG. 3, the profile of the junction surface has four points of inflection (that is, the junction line comprises four points of tangent passing through said junction line). In other embodiments, the profile of the junction surface is a curve having less than two points of inflection for simplifying manufacture of the reinforcement and of the main body. For example, the profile of the junction surface 34C of the vane 1C shown in FIG. 4C is a curve having a point of inflection; the profile of the junction surface 34D of the vane 1D shown in FIG. 4D is an arc of convexity turned towards the structural reinforcement 3.

Also, the reinforcement 3 can have a profile cut by the camber line of the vane (shown in FIG. 3 in long and short alternating dots) into two regions 310, 320 of different respective areas.

In addition, the profile of the intrados 31 and the profile of the extrados 32 of the structural reinforcement 3 can comprise different respective lengths. This asymmetry in length best optimises the length of the junction surface 324 between the reinforcement 3 and the main body 2. It also diminishes the quantity of material and therefore the mass of the reinforcement 3.

Also, the shortest side of the reinforcement 3 (intrados or extrados) can optionally act as a witness to wear by erosion to indicate when the latter is at the end of its life and its replacement has to be made.

In the embodiments illustrated in FIGS. 3 and 4B the profile of the intrados 31 has a length less than the length of the profile of the extrados 32.

Also, in the vane embodiments illustrated in FIGS. 4A, 4C, 4D and 4E, the profile of the intrados 31 has a length greater than the length of the profile of the extrados 32.

The vane is not limited to a single structural reinforcement localised at the level of its leading edge. The vane can in fact comprise a localised structural reinforcement at the level of its trailing edge (and having structural characteristics as per the preceding description, by replacing the leading edge with the trailing edge).

Figure 4E:
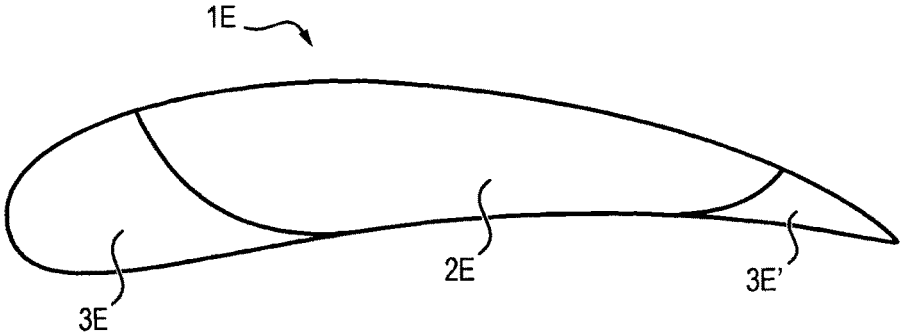
FIG. 4E is a view in transversal section of a vane according to yet another embodiment.

In reference to FIG. 4E, a vane 1E according to another embodiment comprises a main body 2E and a reinforcement 3E at the level of its leading edge and another reinforcement at the level of its trailing edge 3E'. The two reinforcements have each an extrados 32 of length less than the length of its intrados 31.

In a vane variant having two reinforcements not illustrated here, the two reinforcements each have an extrados 32 of length greater than the length of its intrados 31. In another variant not illustrated here, one of the two reinforcements has an intrados 31 of length greater than the length of its extrados 32, and the other of the two reinforcements has an intrados 31 of a length less than the length of its extrados 32.

Multiple items of equipment can comprise one or more vane(s) according to the preceding description, for example a turbine engine.

Materials and Assembly of the Vane

The main body 2 comprises composite material, and the reinforcement 3 comprises metallic material.

The reinforcement 3 preferably comprises metal selected from the group comprising titanium, steel (stainless or not), aluminium, inconel and metallic glasses.

The vane 1 can be made according to a process comprising the following steps.

In a first step, the main composite body 2 is made by draping of prepregs, thermo-compression, injection, compression, Liquid Resin Infusion (LRI), or Resin Film Infusion (RFI). The resins can be thermoplastic (TP), heat-setting (TD), and fillers or not. The fillers or reinforcements can also be mineral, carbon, glass, basalt, flax, hemp, etc.

In a second step, the reinforcement 3 metallic is obtained by forging, stamping, mechanical machining, chemical machining, smelting, laser fusion, sintering, moulding by injection of metal (MIM), moulding under pressure and/or thixomoulding.

The first and second steps can be performed successively or simultaneously.

In a fourth assembly step, the junction surface 34 of the metallic reinforcement 3 is connected to the composite junction surface 24 of the main body 2. This assembly step can comprise mutual fastening of the junction surfaces 24, 34 by adhesion, co-firing, or overmoulding. For example, a primer adhesion coating can be applied to one and/or the other of the junction surfaces 24, 34 prior to assembly of the reinforcement 3 with the main body 2.

The invention claimed is:

1. A turbine engine vane comprising:

a main body made of composite material, a leading edge, a trailing edge, and at least one metal structural reinforcement, the structural reinforcement comprising a junction surface portion connected to the main body, the structural reinforcement extending between the junction surface portion and one of the leading or trailing edges, wherein each profile of the junction surface portion of the structural reinforcement has a camber less than 30% and at least one cracking.

2. The vane according to claim 1, wherein a junction surface portion of the main body to which the junction surface portion of the structural reinforcement is connected, is complementary to the junction surface portion of the structural reinforcement and has a profile identical to the profile of the latter.

3. The vane according to claim 1, wherein the main body comprises an intrados and an extrados, and wherein the structural reinforcement comprises an intrados continuously following the intrados of the main body and an extrados continuously following the extrados of the main body, the intrados and the extrados of the structural reinforcement having respective profiles of different lengths.

4. The vane according to claim 1, comprising a camber line cutting the profile of the structural reinforcement into two different area regions.

5. The vane according to claim 1, wherein each profile of the junction portion of the structural reinforcement comprises less than two points of inflection.

6. The vane according to claim 1, wherein the cracking is an apex introducing a change of direction of angle of between 45° and 90°.

7. A turbine engine comprising at least one vane according to claim 1.

* * * * *